United States Patent [19]

van Olst

[11] 4,451,032

[45] May 29, 1984

[54] PLASTIC SKI SLIDE

[75] Inventor: Gijsbrecht H. J. van Olst, Va Amersfoort, Netherlands

[73] Assignee: Nederlandse Kuntstofindustrie Soesterberg, Soesterberg, Netherlands

[21] Appl. No.: 319,648

[22] Filed: Nov. 9, 1981

[30] Foreign Application Priority Data

Nov. 10, 1980 [NL] Netherlands ..... 8006130

[51] Int. Cl.[3] ..... A63B 69/18

[52] U.S. Cl. ..... 272/56.5 SS; 404/37

[58] Field of Search ..... 272/56.5 SS; 52/278, 52/391, 392, 385, 388; 404/34, 35, 37, 38, 39, 40, 41, 42, 43

[56] References Cited

U.S. PATENT DOCUMENTS

| | | | |
|---|---|---|---|
| 1,932,274 | 10/1933 | Kublanow | 52/385 |
| 1,932,276 | 10/1933 | Kublanow | 52/385 |
| 3,233,893 | 2/1966 | Meyer | 272/56.5 SS |
| 3,443,493 | 5/1969 | Del Piano et al. | 272/56.5 SS |
| 4,047,825 | 9/1977 | Lundahl | 404/37 X |

FOREIGN PATENT DOCUMENTS

| | | | |
|---|---|---|---|
| 262768 | 3/1931 | Italy | 404/37 |

*Primary Examiner*—Robert A. Hafer
*Assistant Examiner*—Arnold W. Kramer
*Attorney, Agent, or Firm*—Watson, Cole, Grindle & Watson

[57] ABSTRACT

A plastic ski slide comprises a rigid reinforcing support of a wickerwork of metal rods, and plastic elements fixed to said reinforcing support. The plastic elements provided with flexible, projecting thin rods are fixed with clearance with respect to each other.

1 Claim, 4 Drawing Figures

PLASTIC SKI SLIDE

BACKGROUND OF THE INVENTION

1. Field of the Invention

The present invention relates to a plastic slide, more particularly a plastic ski slide, comprising an integral surface of retained plastic elements.

2. Description of the Prior Art

Plastic ski slides of this type are known in the art. For that purpose a plurality of plastic elements, comprising at the upper side flexible projections, are snappingly interconnected to one integral slide, each plastic element being secured by means of fixing members, having been sunk into the ground. In order to prevent the growth of weeds beneath the elements, in most cases a felt mat is provided therebelow.

A plastic slide of this type, more particularly a plastic ski slide, is extremely disadvantageous, as such slide may often have an irregular surface, due to expansion of the plastics as a result of ambient temperatures. Very unfavorable circumstances may even involve a cleavage of the elements, thus causing the elements to be rather dangerous when in use.

Another drawback of known plastic slides is that replacing a plastic element is rather difficult and laborious because of the interconnection of the elements. On the other hand, the plastic elements cannot possibly be used without an interconnection as the latter would give rise to an undesired sagging of the mutual elements.

SUMMARY OF THE INVENTION

It is therefore a primary object of the present invention to provide a plastic slide, more particularly a plastic ski slide, which avoids the aforementioned drawbacks.

This object is attained according to the invention in that the plastic elements are fixed in a removable manner, and supported by a rigid reinforcing support. The use of such a rigid reinforcing support comprising recesses enables the plastic elements to be easily kept in the desired shape as the rigid reinforcing support will not be influenced by any soil movements. The plastic elements, on the other hand, are firmly secured upon such a reinforcing support, in such a manner however, that they can be easily replaced when necessary as each plastic element need no longer be interconnected with another plastic element. Repairs, if any, to a plastic slide of this kind, can therefore be performed very quickly.

Maintaining a clearance between the mutual plastic elements can, according to the invention, obviate any expansion of the plastics, therefore excluding any undesired deformations in the surface of the respective slide.

A reinforcing support according to the invention advantageously comprises metal rods, preferably in the form of a wickerwork.

The use of wickerworks of reinforcing steel rods, presents the great advantage that the used reinforcing support is not particularly heavy so that the latter cannot possibly sink too deep into the ground, although the desired support of the plastic elements is, on the other hand, appropriately effected.

Additionally the plastic elements can easily be advantageously secured upon the metal rods of reinforcing supports of this kind by a snapping action, without the plastic elements being interconnected, so that a replacement of worn out or damaged plastic elements can be effected in a very simple and quick manner.

In a favorable embodiment, the plastic elements which are used according to the present invention in a plastic slide, more particularly a plastic ski slide, therefore comprise snapping members which snappingly engage the rigid reinforcing support.

The features of the present invention which are believed novel are set forth with particularity in the appended claims.

Other claims and many of the attendant advantages will be more readily appreciated as the same becomes better understood by reference to the following detailed description and considered in connection with the accompanying drawings in which like reference symbols designate like parts throughout the several views.

DESCRIPTION OF THE PREFERRED EMBODIMENTS.

Figure 1:
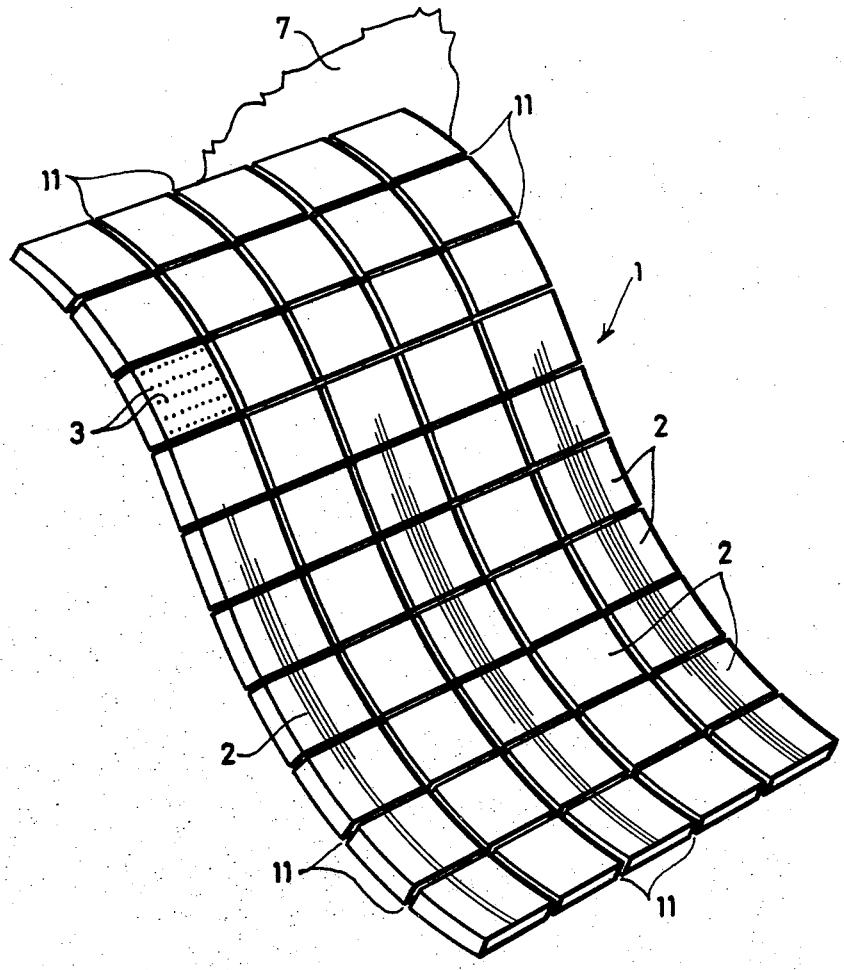
FIG. 1 is a schematic view of a plastic ski slide according to the invention.

Referring now to FIG. 1 an inclined plastic ski track or slide 1 comprises plastic elements 2, the upper surfaces of which comprise flexible wire or rod-shaped plastic projections 3.

Figure 2:
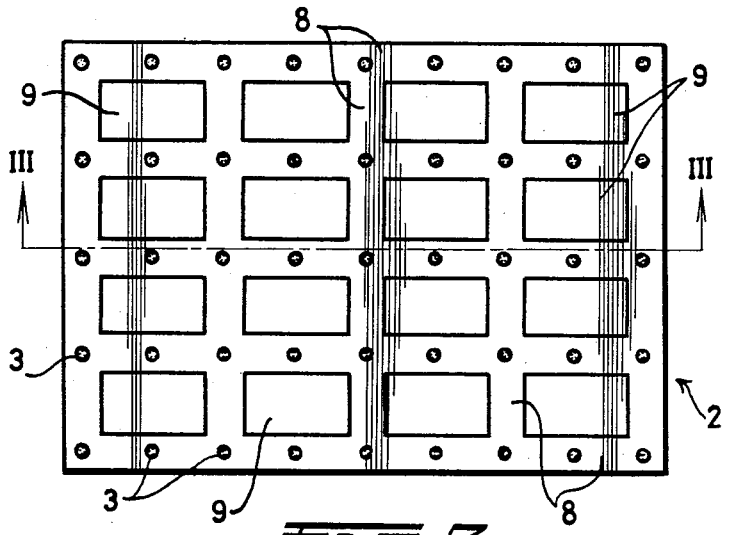
FIG. 2 is a plan view of a plastic element secured upon a reinforcing support.

Referring now to FIG. 2 the plastic elements 2 comprise recesses 9, bounded by plastic rods or beams 8.

Figure 3:
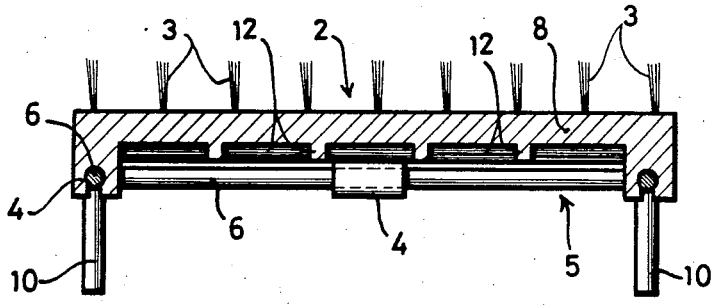
FIG. 3 is a section through a plastic element according to line III—III of FIG. 2.

Referring now to FIG. 3 the plastic elements 2 are snappingly secured upon a reinforcing support 5 by means of snapping members 4. The reinforcing support 5 comprises iron reinforcing rods 6 which preferably have a diameter of between 2 to 7 mm and more particularly of 3 mm, and which have previously been interwoven while adapting the reinforcing layer to be formed to any inclination of the ground. Fixing the reinforcing support 5 on to the ground and anchoring the same may be effected by anchoring extremities 10 of rods 6, although an anchoring by means of separate anchoring pieces (not shown) can obviously also be carried out.

The use of a reinforcing support 5 of such a kind in the form of interwoven metal rods, provides an extremely good fixation of the plastic ski track or slide according to the invention. Also the weight of the reinforcing support 5 comprising interwoven metal rods 6 is such, that the reinforcing support 5 will never sink too far into the ground 7. An easy transport of the reinforcing support may preferably be carried out by constructing the reinforcing support in the form of reinforcing elements, which are preferably stackable, so that a large number of them can be conveyed without the elements occupying too much space.

The plastic elements 2 are advantageously injection-moulded thermoplastic or elastomeric elements, more particularly elements of polyvinylchloride, containing a plasticizer, although polyethylene is also a very suitable material for this purpose.

Although FIG. 1 shows that the plastic elements comprise projecting thin, wire-shaped members 3, such wire-shaped members may obviously be replaced by other members 3, which are suitable when skiing upon a plastic slide 1.

A damaged plastic element 2 can easily be replaced by disconnecting the snap-connection between the element and the reinforcing support and a subsequent replacement of the plastic element. It has been found in practice that the abovedescribed repair of a plastic ski slide can be performed very rapidly, which is very important for the operator, while assuming that the plastic ski slides always have a smooth, inclined course as the plastic elements are retained and supported by a rigid reinforcement 5.

It is an additional very important advantage of the slide according to the present invention that any repairs not be laborious and can be performed by unskilled persons, due to the possibility of an easy replacement of a damaged element 2 upon the reinforcing support 5. This is contrary to the construction of known plastic ski slides in which each plastic element must be secured by means of rods to be driven into the soil.

It is still a further important advantage of the plastic ski slide according to the invention that the plastic ski slide can be built up by means of a considerably smaller quantity of plastics, which is extremely important in view of the high cost of plastics. A support by means of a reinforcing support 5 will cause the plastic elements 2 to be extremely rigid.

If desired, the spaces between the plastic rods or beams 8 can be filled by means of a foam plastic layer. The plastic elements may also be provided with a foam plastic having a closed surface of a strength sufficient to be resistant against the forces exerted upon the same during skiing upon the slide.

Reverting now to FIG. 1 it can be seen that the plastic elements 2 are fixed from each other, with a clearance 11 enabling them to expand without impeding each other. The clearance compensates for the expansion of the plastic elements due to high temperatures, so that two subsequent elements will not give rise to the formation of undesired upwardly projecting, and also dangerous, ridges.

Figure 4:
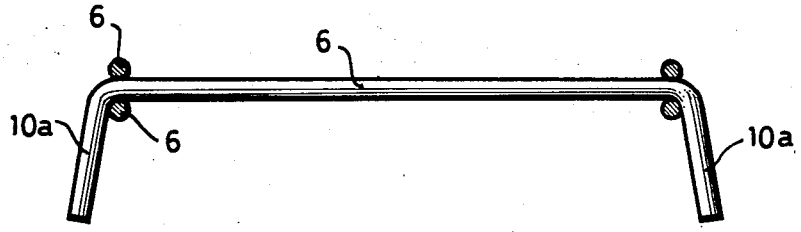
FIG. 4 is a section through a modified reinforcing support used in the plastic ski slide of FIG. 1.

Referring now to FIG. 4 in a modified embodiment of a reinforcing support 5 the extremities 10*a* of rods 6 being bent downwardly, are bent downwardly obliquely, so that said reinforcement portions can be easily conveyed by stacking them.

What is claimed is:

1. A ski slide, comprising:

a plurality of rods interconnected so as to form a support foundation gridwork having predetermined spacing defined between said rods;

means for anchoring said gridwork to a ground support surface; and a plurality of modular plastic elements having means projecting from a first surface portion of each of said elements for coaction with a ski, and further comprising connecting means formed upon a second surface portion, said connecting means adapted for removably securing each of said elements to said gridwork and adapted for lateral and longitudinal registration and connection with said gridwork, such that connection of said elements with said gridwork defines a mutual spacing between each of said elements for permitting expansion of said elements without contact therebetween.

* * * * *